United States Patent [19]

Schmidt et al.

[11] Patent Number: 4,985,987

[45] Date of Patent: Jan. 22, 1991

[54] FASTENER ATTACHING APPARATUS

[76] Inventors: Volker Schmidt, 4638 Todds Rd.; Eric A. Schmidt, 2415 Liberty Rd., both of Lexington, Ky. 40509

[21] Appl. No.: 463,488

[22] Filed: Jan. 11, 1990

[51] Int. Cl.[5] ..... A41H 37/04

[52] U.S. Cl. ..... 29/788; 227/15; 227/18

[58] Field of Search ..... 29/771, 787, 788; 227/15, 18, 19, 20, 22

[56] References Cited

U.S. PATENT DOCUMENTS

| | | | |
|---|---|---|---|
| 2,852,777 | 9/1958 | Cohn | 227/18 |
| 2,908,908 | 10/1959 | Steinmetz et al. | 227/18 |
| 3,265,275 | 8/1966 | Wilson | 227/18 |
| 4,606,487 | 8/1986 | Douri | 227/18 X |

*Primary Examiner*—Timothy V. Eley

*Attorney, Agent, or Firm*—Frank C. Leach, Jr.

[57] ABSTRACT

A two prong symmetrical shaped element is connected to a non-symmetrical shaped element on opposite sides of a material by disposing the two prongs in two holes in the non-symmetrical shaped element, which is a hook or an eye. The non-symmetrical shaped element is supplied from a hopper through a feed chute to a guide channel in which it is advanced to a setting station where it is attached to the two prong element by cooperation of an anvil and a ram. When the non-symmetrical shaped element is a hook, its orientation is changed by a rotatable transport stop disposed betwen two portions of the feed chute during advancement of the hook through the feed chute. When the non-symmetrical shaped element is an eye, its orientation is changed during its advancement through the guide channel prior to its disposition at the setting station.

20 Claims, 7 Drawing Sheets

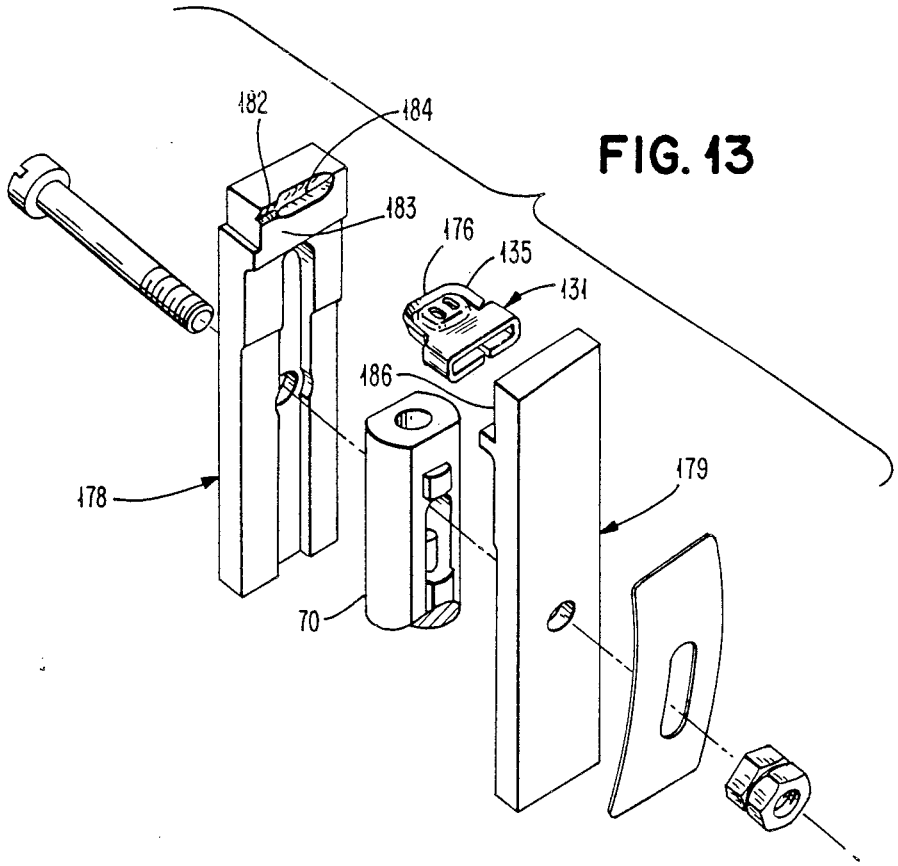
FIG. 13
FIG. 14
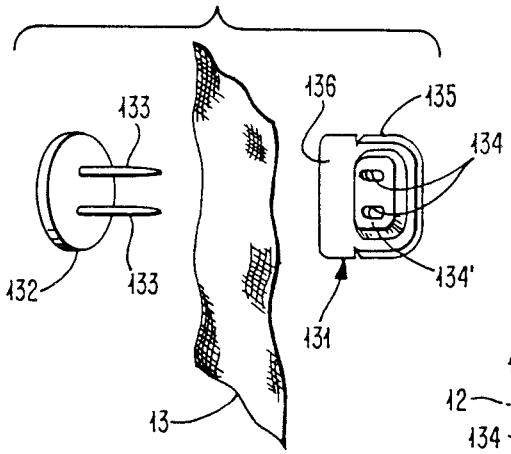
FIG. 15
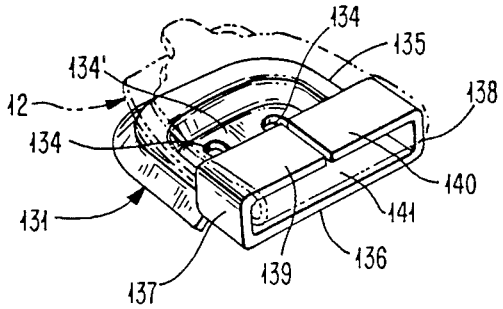

FASTENER ATTACHING APPARATUS

This invention relates to an apparatus for attaching a two prong element of a fastener and a non-symmetrical shaped element to material on opposite sides thereof and, more particularly, to an attaching apparatus having an arrangement for orienting each non-symmetrical shaped element prior to its disposition at a setting station at which the two prong element and the non-symmetrical shaped element are attached to opposite sides of the material.

U.S. Pat. No. 3,750,925 to Schmidt et al, which is incorporated by reference herein, has an arrangement for disposing a symmetrical two prong head element of a snap fastener with its two prongs in a specific position at the time that the two prongs are forced into a backing element to attach the head element and the backing element to a material therebetween. U.S. Pat. No. 3,964,661 to Schmidt et al, which is incorporated by reference herein, has a dome shaped backing element into which the two prongs of the two prong symmetrical head element are forced.

It has previously been suggested to form a hook or eye with two prongs for penetration through the material to which the hook or eye is to be attached and into two holes in an aligned backing plate. The prongs are then bent to attach the hook or eye to the backing plate and the material.

It also has previously been suggested to form a decorative head having a single large prong forced through the material and retained by a backing retainer. This forcing of the large prong through the material produces a hole in the material; thus, if replacement is necessary, the material becomes defective because of the hole. This type of decorative head with the single large prong is employed with button holes on jeans, for example.

This type of decorative head also could be employed as part of a snap fastener. The decorative head would be on the exterior of a portion of the material with one portion of the snap fastener attached thereto on the interior; this also produces a hole in the material. The other portion of the snap fastener would be similarly attached to another portion of the material in the same manner. The two portions of the material are held together by the snap fastener.

Some children find it difficult to connect a decorative head button within a button hole such as on a pair of jeans, for example. However, children are able to easily attach a hook and eye fastener since this only requires lateral movement of one of the two parts relative to the other. The presently available hook and eye fasteners are not capable of being employed with a decorative head element as is desired by children on jeans, for example, in the same manner as adult jeans have a decorative head element.

The apparatus of the present invention satisfactorily solves the foregoing problems through attaching a decorative head element to a hook or eye without producing a hole in the material. This is accomplished by the use of two prongs on the decorative head element extending through the material into two holes in a non-symmetrical shaped hook or eye with the two prongs being deformed after passing through the two holes.

The other of the non-symmetrical shaped hook or eye is secured to another portion of the material that is to be connected to the portion having the decorative head element. Its connection is made through having a symmetrical retaining element formed with two prongs for disposition within two holes in the hook or eye with the two prongs being deformed after passing through the two holes.

Accordingly, the apparatus of the present invention enables the use of a symmetrical two prong element, which can be a decorative element, to be readily attached to a non-symmetrical shaped hook or eye element having two holes therein. This avoids damage to the material if replacement of the hook or eye is necessary while still permitting the use of a decorative element with a hook and eye fastener.

The apparatus of the present invention accomplishes this through orienting the non-symmetrical shaped hook or eye so that the two holes therein can receive the two prongs of the symmetrical element of the fastener. Because the hook and eye have different non-symmetrical configurations, each must be oriented in a different manner. However, each of the hook and eye is oriented prior to being disposed at a setting station at which the hook or eye has its two holes disposed to receive the two prongs of the symmetrical element.

An object of this invention is to attach a non-symmetrical hook or eye and a two prong element to each other with a material therebetween.

Another object of this invention is to provide a unique feeding arrangement for a non-symmetrical hook or eye that is to be attached to a two prong element with a material therebetween.

Other objects of this invention will be readily perceived from the following description, claims, and drawings.

This invention relates to an apparatus for attaching a two prong element and a non-symmetrical shaped element to material at a setting station including anvil means and ram means at the setting station and activating means for activating the anvil means and the ram means to move the anvil means and the ram means toward each other with each of the ram means and the anvil means being movable only axially. A first hopper has a plurality of two prong elements therein, and a second hopper has a plurality of non-symmetrical shaped elements therein with each of the non-symmetrical shaped element having two holes therein to receive the prongs on the two prong element. First transport means transports each of the two prong elements from the first hopper to a position at the setting station in a specific orientation for engagement by the anvil means, and second transport means transports each of the non-symmetrical shaped elements from the second hopper to the setting station for engagement by the ram means with the second transport means transporting each of the non-symmetrical shaped elements from the second hopper in a first orientation. The second transport means has cooperating means for cooperating with each of the non-symmetrical shaped elements prior to its disposition at the setting station to dispose each of the non-symmetrical shaped elements in a second orientation, different from the first orientation, for engagement by the ram means with the two holes in the non-symmetrical shaped element oriented to receive the two prongs of the two prong element engaged by the anvil means.

The attached drawings illustrate preferred embodiments of the invention, in which:

FIG. 13 is an exploded perspective view of side plates of ram means of the attaching apparatus of FIG. 9 and an eye to be retained therein;

FIG. 14 is a perspective view of a non-symmetrical eye, a symmetrical head having two prongs to which the eye is to be attached, and material through which the prongs pass; and FIG. 15 is a perspective view of another portion of the eye of FIG. 14 and showing a hook in phantom disposed within the eye.

Figure 1:
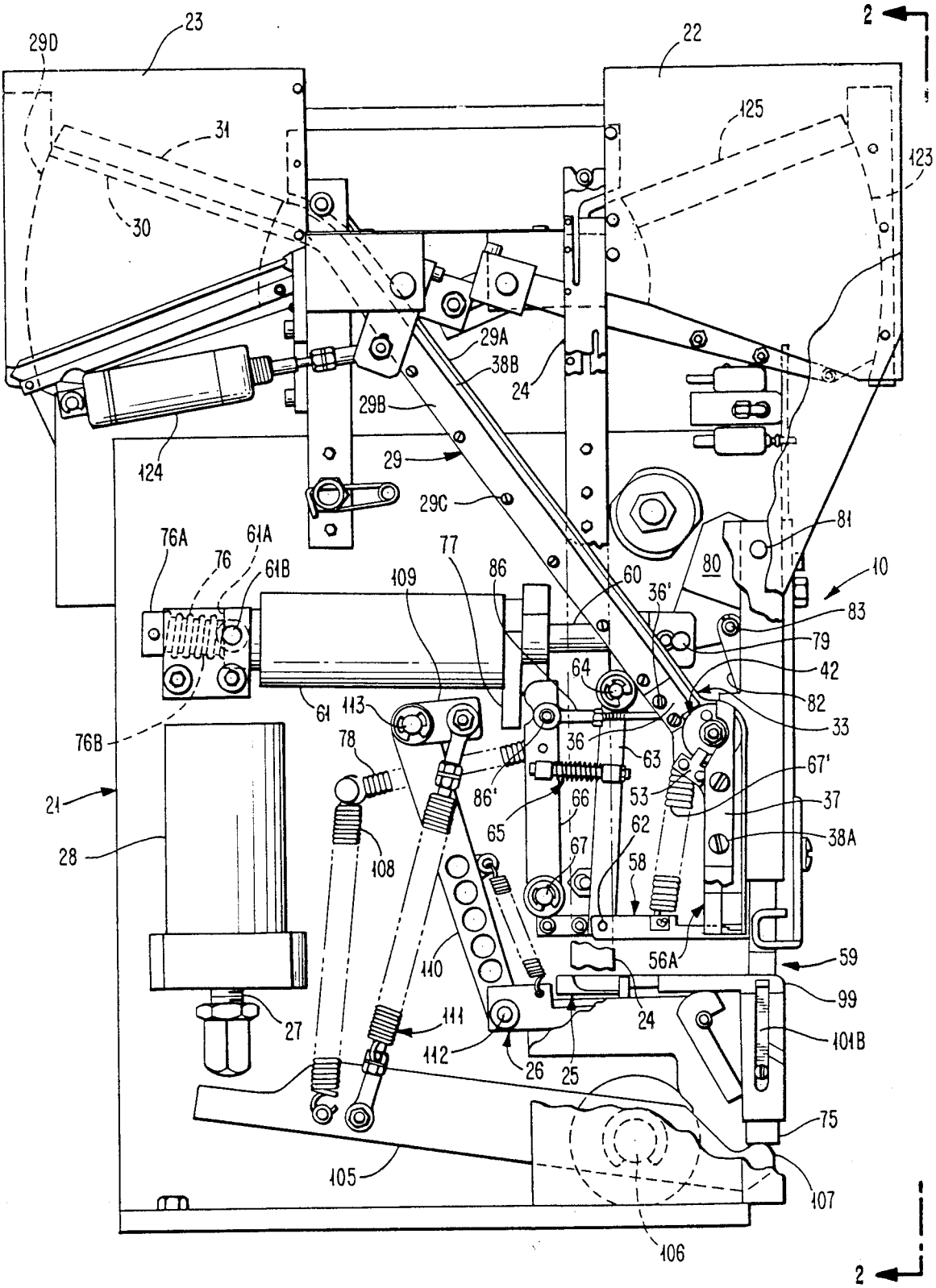
FIG. 1 is a side elevational view of an attaching apparatus for attaching a non-symmetrical hook to a symmetrical element and having a unique feeding arrangement for orienting the hook.
Figure 7:
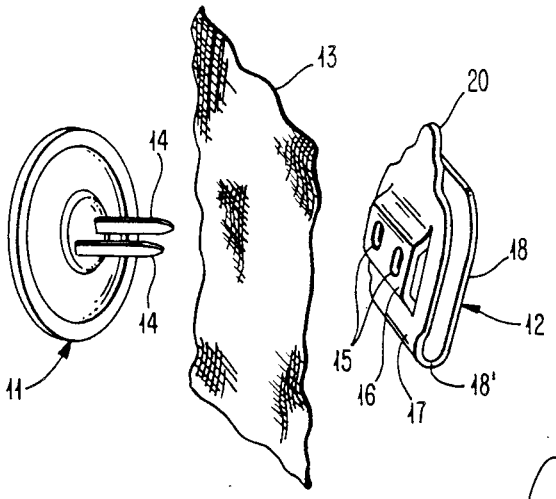
FIG. 7 is a perspective view of a non-symmetrical hook, a symmetrical head having two prongs to which the hook is to be attached, and material through which the prongs pass.

Referring to the drawings and particularly FIG. 1, there is shown an attaching apparatus 10 for attaching a two prong head 11 (see FIG. 7) to a non-symmetrical shaped hook 12 with a material 13 such as jeans, for example, therebetween. The head 11, which is symmetrical but could have other shapes, if desired, has two prongs 14 extending therefrom for disposition in two holes 15 in the hook 12 after the prongs 14 have passed through the material 13.

Figure 8:
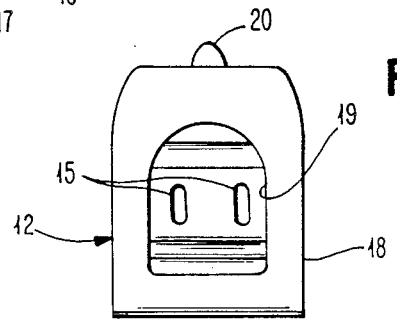
FIG. 8 is a plan view of another portion of the hook of FIG. 7.

The hook 12 has the holes 15 in a raised area 16 of a first portion 17, which is substantially parallel to a second portion 18 connected to the first portion 17 by a connecting portion 18'. The second portion 18 has an enlarged opening 19 (see FIG. 8) therein and with which the two holes 15 are aligned. The first portion 17 has a tongue 20 (see FIG. 7) extending from its free end and extending slightly beyond the free end of the second portion 18 as shown in FIG. 8.

The attaching apparatus 10 (see FIG. 1) includes a plate-like support 21 having hoppers 22 and 23 mounted at its upper end. In the same manner as shown and described in the aforesaid Schmidt et al patents, a feed chute 24, which includes a rail and a cover, extends between an outlet of the hopper 22 and a guide channel 25 to transport each of the heads 11 (see FIG. 7) to the guide channel 25 (see FIG. 1).

The guide channel 25, which is shown and described in the aforesaid Schmidt et al patents, aligns the prongs 14 (see FIG. 7) of the head 11 in the correct orientation as each of the heads 11 is advanced through the guide channel 25 (see FIG. 1) by a slide bar 26 in the manner shown and described in the aforesaid Schmidt et al patents. The slide bar 26 is reciprocated in the guide channel 25 by motion of a piston rod 27 of an air cylinder 28, which is mounted on the support 21.

The hopper 23 has the hooks 12 (see FIG. 3) therein. An upper feed chute 29 (see FIG. 1) has its upper end supported by the hopper 23. The upper feed chute 29, which includes a rail 29A and a cover 29B attached to the rail 29A by screws 29C, has its upper end receive each of the non-symmetrical shaped hooks 12 (see FIG. 3) from an outlet of the hopper 23.

Figure 3:
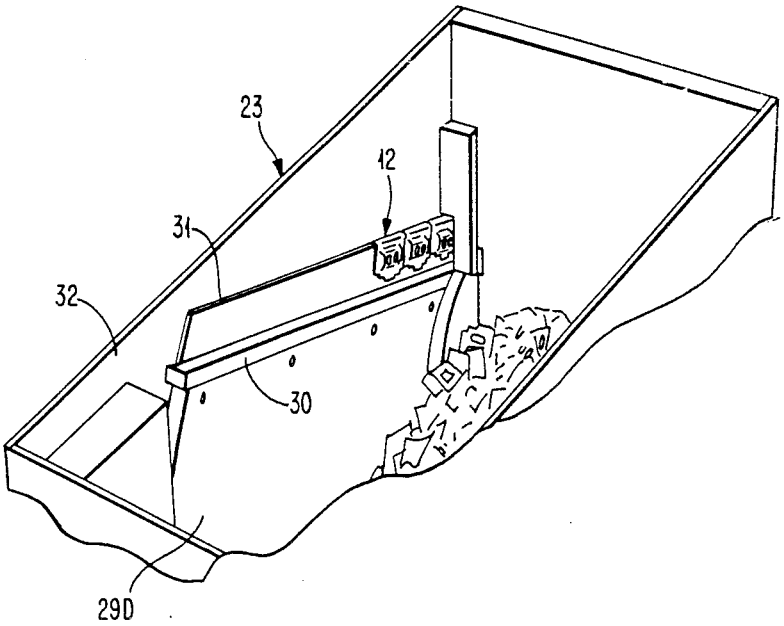
FIG. 3 is a fragmentary perspective view of a portion of a hopper of the attaching apparatus of FIG. 1 with the hopper having an arrangement for supplying hooks to a feed chute.

As shown in FIG. 3, a pivotally mounted knife blade 29D has a bar 30 at its upper end with a rail 31 supported on its upper surface adjacent a rear wall 32 of the hopper 23. The rail 31 is spaced from the inner surface of the rear wall 32 of the hopper 23 to receive only the second portion 18 (see FIG. 7) of the hook 12. This disposes the hook 12 in the desired orientation each time that the knife blade 29D (see FIG. 3) is pivoted within the hopper 23. The raised portion 16 (see FIG. 7) of the hook 12 prevents the first portion 17 from entering between the rear wall 32 (see FIG. 3) and the rail 31.

The hopper 23 has its outlet shaped so that each of the hooks 12 can pass therethrough only when the hook 12 has the desired orientation with the second portion 18 (see FIG. 7) of the hook 12 disposed between the rail 31 (see FIG. 3) and the rear wall 32 of the hopper 23. Therefore, only each of the hooks 12 on the rail 31 having the desired orientation will enter the upper end of the upper feed chute 29 (see FIG. 1).

The lower end of the upper feed chute 29 is connected to an upper end of an intermediate feed chute 33. The intermediate feed chute 33 includes a rail 34 (see FIG. 4) having its upper portion 35 connected to the rail 29A (see FIG. 1) of the upper feed chute 29. The intermediate feed chute 33 (see FIG. 4) includes an upper cover 36, which is secured to the upper portion 35 of the rail 34 by screws 36' (see FIG. 1), and a lower cover 37 (see FIG. 4), which is secured to a lower portion 38 of the rail 34 by screws 38A (see FIG. 1).

Each of the hooks 12 (see FIG. 7) rides along the edge of the cover 29B (see FIG. 1) of the upper feed chute 29 with the first portion 17 (see FIG. 7) of the hook 12 disposed exterior of the cover 29B (see FIG. 1) and the second portion 18 (see FIG. 7) within a channel 38B (see FIG. 1) in the rail 29A of the upper feed chute 29. Each of the hooks 12 (see FIG. 4) advances onto the upper cover 36 of the intermediate feed chute 33 in the same manner.

The rail 34 has an enlarged circular chamber 39 therein communicating with a channel 40 in the upper portion 35 of the rail 34 and a channel 41 in the lower portion 38 of the rail 34. A transition wheel 42, which functions as a transport stop for each of the hooks 12, is rotatably mounted within the channel 39 for rotation between first and second positions.

The transition wheel 42 is mounted on a reduced end 43 of a shaft 44 for rotation therewith. The shaft 44 is rotatably supported by a bearing 45 within an opening 46 in the rail 34.

The shaft 44 also extends through a bearing 47 in an opening 48 in a bearing block 49, which is secured to the back of the rail 34. The end of the shaft 44 is retained within an actuator 50.

The transition wheel 42 is movable between its first position in which a stop pin 51 on the transition wheel 42 engages a first shoulder 52 on a stop 53, which is secured to the rail 34, and its second position in which a stop pin 54 on the transition wheel 42 engages a second shoulder 55 on the stop 53. When in its first position, the transition wheel 42 has a protruding portion 56 aligned with the channel 40 in the upper portion 35 of the rail 34 to receive the lowermost of the hooks 12 in the channel 40 of the upper portion 35 of the rail 34 when the transition wheel 42 is in its first position.

The clockwise rotation of the transition wheel 42 to its second position transports the hook 12 to a position in which the hook 12 is disposed on the cover 37 and in the channel 41 of the lower portion 38 of the rail 34. This rotates the hook 12 135° clockwise to change its orientation so that the tongue 20 is now vertical. Thus, the hook 12 has changed from a first orientation to a second orientation.

Figure 5:
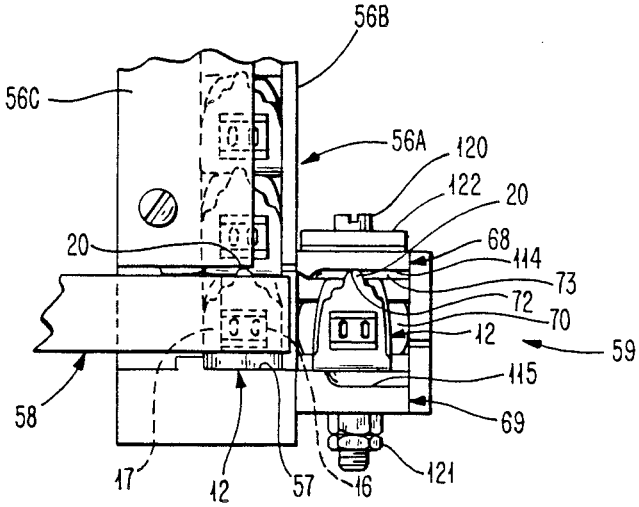
FIG. 5 is a fragmentary bottom plan view of a portion of the attaching apparatus of FIG. 1 and showing a guide channel within which each hook enters from the feed chute prior to the hook being disposed at a setting station and a feed in finger disposed in the guide channel.

The hook 12 remains in its second orientation as the hook 12 advances from the intermediate feed chute 33 into a curved lower feed chute 56A (see FIG. 5), which includes a curved rail 56B and a curved cover 56C. Therefore, when the hook 12 exits from the lower feed chute 56A to change from a vertical disposition when it entered the lower feed chute 56A to a horizontal disposition, the hook 12 enters a horizontally disposed guide channel 57 properly oriented with the second portion 18 (see FIG. 7) of the hook 12 above the first portion 17.

Figure 6:
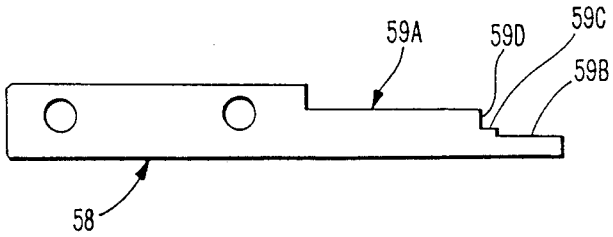
FIG. 6 is a side elevational view of the feed in finger of FIG. 5.

A feed in finger 58 (see FIG. 5) reciprocates in the guide channel 57 between a position in which the lowermost of the hooks 12 in the lower feed chute 56A can enter the guide channel 57 to a position in which the hook 12 is advanced in the guide channel 57 to a setting station 59. The advancement of the feed in finger 58 disposes a portion 59A (see FIG. 6) of the feed in finger 58 to block the lower feed chute 56A (see FIG. 5) to prevent another of the hooks 12 in the lower feed chute 56A from entering the guide channel 57. The feed in finger 58 includes a reduced portion 59B (see FIG. 6) on which the raised area 16 (see FIG. 5) of the first portion 17 of the hook 12 rests. The feed in finger 58 includes a surface 59C (see FIG. 6) on which part of the first portion 17 (see FIG. 5) of the hook 12 rests and a shoulder 59D (see FIG. 6) acting against the second portion 18 (see FIG. 7) of the hook 12.

The feed in finger 58 (see FIG. 1) is reciprocated by extension and retraction of a piston rod 60 of an air cylinder 61, which is slidably supported on a block 61A pivotally mounted on the support 21 by a pivot pin 61B. The feed in finger 58 is connected by a pivot pin 62 to the lower end of a lever 63, which is pivotally mounted at its upper end on the support 21 by a pivot pin 64. The lever 63 is resiliently connected by a resilient connector 65 to a lever 66, which is pivotally mounted at its lower end on the support 21 by a pivot pin 67. A spring 67' continuously urges the feed in finger 58 upwardly so that the portion 59A (see FIG. 6) is always held against the top of the guide channel 57 (see FIG. 5).

Figure 2:
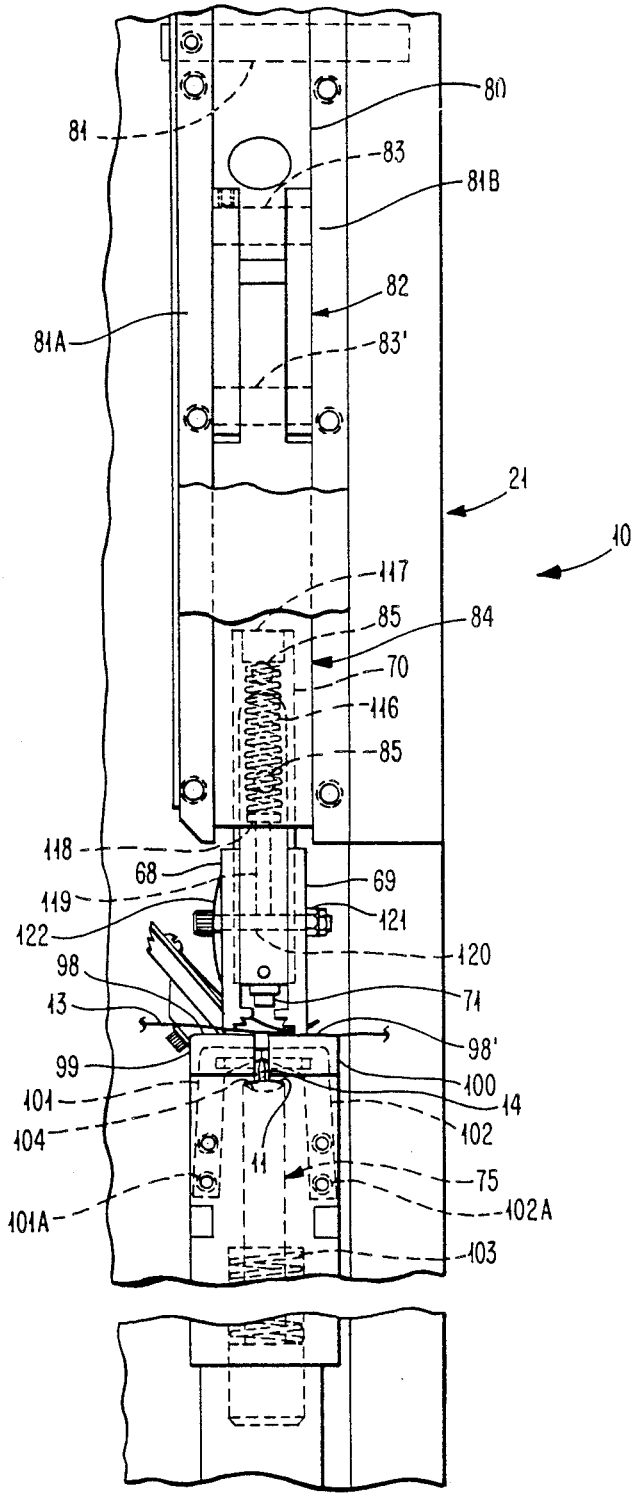
FIG. 2 is a fragmentary end elevational view of the attaching apparatus of FIG. 1 and taken along line 2—2 of FIG. 1.

When the feed in finger 58 is advanced inwardly, the hook 12 is advanced by the feed in finger 58 between two side plates 68 (see FIG. 2) and 69, which are mounted on a cylinder 70 having a die 71 therein at its bottom end. The side plate 68 has a cut out portion 72 (see FIG. 5) in a surface 73 to receive the tongue 20 of the hook 12 when the hook 12 is advanced from the guide channel 57 between the side plates 68 and 69. This properly orients the hook 12 with respect to the die 71 (see FIG. 2) and to the prongs 14 (see FIG. 7) on the head 11, which is disposed beneath the material 13 and the hook 12. The head 11 is disposed for upward movement by an anvil 75 (see FIG. 2) so that the prongs 14 (see FIG. 7) of the head 11 will enter the holes 15 in the hook 12 and be deformed by downward movement of the die 71 (see FIG. 2).

The feed in finger 58 (see FIG. 5) is advanced into the guide channel 57 to feed another of the hooks 12 between the side plates 68 and 69 when the piston rod 60 (see FIG. 1) is retracted into the air cylinder 61. This causes the air cylinder 61 to move to the right against the force of a spring 76, which is continuously urging the cylinder 61 to the left in FIG. 1 through acting on a collar 76A on a reduced portion 76B of the cylinder 61. This motion of the air cylinder 61 to the right in FIG. 1 results in a finger 77 on the air cylinder 61 engaging the upper end of the lever 66 to pivot it clockwise about the pivot pin 67 against the force of a spring 78, which is continuously urging the lever 66 counterclockwise about the pivot pin 67.

This clockwise pivoting of the lever 66 is transmitted by the resilient connector 65 to cause counterclockwise pivoting of the lever 63 about the pivot pin 64. This advances the feed in finger 58 to the right in FIG. 1 to dispose another of the hooks 12 (see FIG. 7) between the side plates 68 (see FIG. 2) and 69.

The piston rod 60 (see FIG. 1) is pivotally connected by a pivot pin 79 to a link 80, which is pivotally connected by a pivot pin 81 to a pair of parallel plates 81A (see FIG. 2) and 81B on the support 21. A second link 82 is pivotally connected by a pivot pin 83 to the link 80 and by a pivot pin 83' to a ram 84. Thus, the retraction of the piston rod 60 (see FIG. 1) also retracts the ram 84 (see FIG. 2), which has the cylinder 70 connected thereto by two set screws 85 so that the die 71 is retracted. This is necessary to enable advancement of the feed in finger 58 (see FIG. 1) to the right to dispose another of the hooks 12 (see FIG. 7) between the side plates 68 (see FIG. 2) and 69.

When the piston rod 60 (see FIG. 1) is retracted into the air cylinder 61 whereby the lever 66 is pivoted clockckwise by movement of the air cylinder 61 to the right in FIG. 1, the transition wheel 42 (see FIG. 4) is rotated clockwise to advance another of the hooks 12 to the lower portion 38 of the rail 34 and the lower cover 37 of the intermediate feed chute 33. The transition wheel 42 is rotated clockwise through the shaft 44 being connected to the lever 66 (see FIG. 1). The connection between the lever 66 and the shaft 44 (see FIG. 4) includes a rod end bearing 86 pivotally connected to the lever 66 (see FIG. 1) by a pivot pin 86'. The rod end bearing 86 (see FIG. 4) is attached to a threaded end 87 of a link 88 by a nut 89 and a lock washer 90. The link 88 is attached to the actuator 50 by a pin 91. Therefore, pivotal motion of the lever 66 (see FIG. 1) is transferred into rotary motion of the transition wheel 42 (see FIG. 4).

When the transition wheel 42 is rotated clockwise, a circular peripheral portion 92 of the transition wheel 42 engages the lowermost of the hooks 12 on the upper cover 36 to effectively block the bottom of the upper cover 36 to prevent the lowermost of the hooks 12 from falling into the chamber 39 in the rail 34. Therefore, only one of the hooks 12 can be advanced by the transition wheel 42 at any time.

The transition wheel 42 can be manually rotated between its first and second positions by grasping the stop pin 51. The transition wheel 42 can be rotated manually relative to the reduced end 43 of the shaft 44 because of a clutch 93, a spring washer 94, a nut clutch 95, a lock washer 96, and a nut 97 holding the transition wheel 42 on the reduced end 43 of the shaft 44. This enables manual filling of the lower portion 38 of the rail 34 with the hooks 12 when desired.

When the piston rod 60 (see FIG. 1) is extended so that the air cylinder 61 is moved to the left in FIG. 1 by the force of the spring 76 whereby the lever 66 pivots counterclockwise under the force of the spring 78, the rod end bearing 86 is moved to the left in FIG. 1. This rotates the transition wheel 42 (see FIG. 4) counterclockwise from its second position to its first position so that the protruding portion 56 of the transition wheel 42 receives the lowermost of the hooks 12 on the upper cover 36 of the intermediate feed chute 33.

When the piston rod 60 (see FIG. 1) is extended, the ram 84 (see FIG. 2) and the attached cylinder 70 move downwardly. This causes the side plates 68 and 69 to engage the material 13 and hold the material 13 against upper surfaces 98 and 98' of members 99 and 100 forming the guide channel 25 (see FIG. 1) as more particularly shown and described in the aforesaid Schmidt et al patents. The head 11 (see FIG. 7) is held in position by a pair of pivotally mounted gripping jaws 101 (see FIG. 2) and 102, which are pivotally mounted on screws 101A and 102A, respectively, and normally biased towards each other by flat springs (one shown at 101B in FIG. 1 for the jaw 101), as more particularly shown and described in the aforesaid Schmidt et al patents.

As the anvil 75 (see FIG. 2) is moved upwardly against the force of a spring 103, a slightly concave upper surface 104 of the anvil 75 receives the head 11 (see FIG. 7) and the jaws 101 (see FIG. 2) and 102 are cammed out of engagement with the head 11 (see FIG. 7) by the upward movement of the anvil 75 (see FIG. 2) as more particularly shown and described in the aforesaid Schmidt et al, U.S. Pat. No. 3,750,925.

The anvil 75 is moved upwardly when the piston rod 27 (see FIG. 1) is extended from the air cylinder 28 to cause a lever 105 to pivot counterclockwise about its pivot pin 106, which pivotally mounts the lever 105 on the support 21. This causes a toe 107 on the end of the lever 105, which is engaging the bottom of the anvil 75, to move the anvil 75 upwardly.

The lever 105, which is continuously urged clockwise by a spring 108, is pivotally connected to a finger 109 of an arm 110 by a resilient connector 111. The lower end of the arm 110 is pivotally connected by a pivot pin 112 to the slide bar 26. Therefore, when the lever 105 pivots counterclockwise against the force of the spring 108, the arm 110 is pivoted clockwise about its pivot pin 113 to withdraw the slide bar 26 to a retracted position in the manner more particularly shown and described in the aforesaid Schmidt et al patents. The resilient connector 111 allows movement of the lever 105 to continue after the slide bar 26 has been retracted or extended to its desired position.

As the anvil 75 is moved upwardly, the prongs 14 (see FIG. 7) on the head 11 enter the two holes 15 in the hook 12 after passing through the material 13. Each of the side plates 68 (see FIG. 5) and 69 has a surface 114 and 115, respectively, to receive circumferential portions of the head 11 (see FIG. 7).

As the ram 84 (see FIG. 2) and the cylinder 70 move downwardly, the guide plates 68 and 69 are prevented from further movement because of engagement with the upper surfaces 98 and 98' of the members 99 and 100, respectively. However, the ram 84 and the cylinder 70 can continue to move because the side plates 68 and 69 are resiliently connected to the cylinder 70.

The resilient connection between the cylinder 70 and the side plates 68 and 69 includes a spring 116 disposed within the cylinder 70 and having one end engaging a screw 117 at the upper end of the cylinder 70. The other end of the spring 116 engages a head 118 of a pin 119. The pin 119 engages a bolt 120, which passes through a passage in the cylinder 70 and cooperates with a nut 121 to retain the side plates 68 and 69 on the cylinder 70.

As the cylinder 70 moves downwardly relative to the side plates 68 and 69 while the anvil 75 is moving upwardly, the die 71 engages the prongs 14 (see FIG. 7) on the head 11 to deform them. Because of a spring 122 (see FIG. 2) acting on the side plate 68, the side plates 68 and 69 separate slightly from each other to cease to hold the hook 12 (see FIG. 7). This occurs after the die 71 (see FIG. 2) has engaged the prongs 14 (see FIG. 7) of the head 11 and deformed them.

Considering the operation of the attaching apparatus 10 (see FIG. 1), the feed chute 24 is substantially filled from the hopper 22 with the heads 11 (see FIG.7) having the two prongs 14. The upper feed chute 29 (see FIG. 1), the intermediate feed chute 33, and the lower feed chute 56A are substantially filled with the hooks 12 (see FIG. 7). At this time, the protruding portion 56 (see FIG. 4) of the transition wheel 42 has one of the hooks 12 thereon.

The supply of pressurized air to the air cylinder 61 (see FIG. 1) to retract the piston rod 60 into the air cylinder 61 results in the air cylinder 61 moving to the right against the force of the spring 76. This moves the finger 77 into engagement with the lever 66 to cause clockwise pivoting of the lever 66 and counterclockwise pivoting of the lever 63.

The counterclockwise pivoting of the lever 63 advances the hook 12 (see FIG. 5) within the guide channel 57 by advancing the feed in finger 58. Thus, one of the hooks 12 is disposed between the side plates 68 and 69 at the setting station 59 (see FIG. 1).

Figure 4:
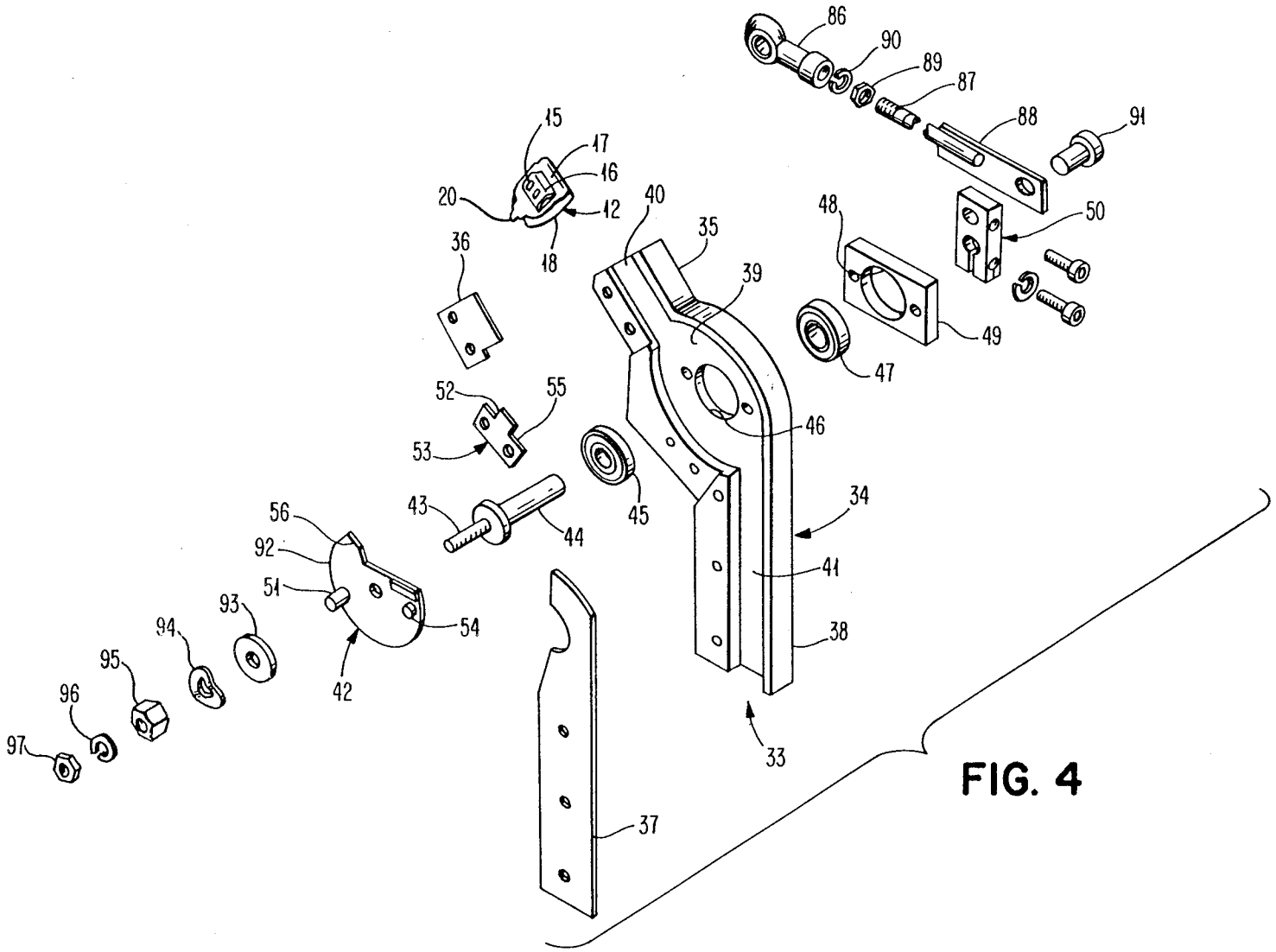
FIG. 4 is an exploded perspective view of a portion of the attaching apparatus of FIG. 1 and showing a connecting arrangement for a rotatable transition wheel that changes the orientation of the hook in the feed chute.

The clockwise pivoting of the lever 66 advances the rod end bearing 86 to the right in FIG. 1 to produce clockwise rotation of the transition wheel 42 (see FIG. 4). This moves the hook 12 on the protruding portion 56 of the transition wheel 42 to the lower portion 38 of the rail 34 and the lower cover 37. This also disposes the circular peripheral portion 92 of the transition wheel 42 in engagement with the lowermost of the hooks 12 on the upper cover 36 to effectively block the lower end of the upper cover 36.

At the same time, pressurized air is supplied to the air cylinder 28 (see FIG. 1) to retract the piston rod 27 into the air cylinder 28. This results in the spring 108 pivoting the lever 105 clockwise about the pivot pin 106 so that the slide bar 26 advances one of the heads 11 (see FIG. 7) through the guide channel 25 (see FIG. 1) into a position between the jaws 101 (see FIG. 2) and 102.

With the head 11 (see FIG. 7) and the hook 12 disposed at the setting station 59 (see FIG. 1), pressurized air is supplied to the air cylinder 61 to extend the piston rod 60. This results in the spring 76 moving the air cylinder 61 and the finger 77 to the left in FIG. 1. The movement of the finger 77 to the left in FIG. 1 allows the spring 78 to cause counterclockwise pivoting of the lever 66 and clockwise pivoting of the lever 63. Clockwise pivoting of the lever 63 withdraws the feed in finger 58 from the guide channel 57 (see FIG. 5). Then, the ram 84 (see FIG. 2), the cylinder 70, and the die 71 move downwardly.

The counterclockwise pivoting of the lever 66 (see FIG. 1) pulls the rod end bearing 86 to the left. This produces counterclockwise rotation of the transition wheel 42 (see FIG. 4) to dispose the protruding portion 56 of the transition wheel 42 to receive another of the hooks 12 from the upper cover 36.

At the same time that the pressurized air is supplied to the air cylinder 61 (see FIG. 1) to extend the piston rod 60 therefrom, pressurized air is supplied to the air cylinder 28 to extend the piston rod 27 therefrom. This pivots the lever 105 counterclockwise so that the slide bar 26 is withdrawn from the guide channel 25. This also moves the anvil 75 (see FIG. 2) upwardly whereby the head 11 (see FIG. 7) and the hook 12 are attached to the material 13.

During the cycle of operation, the knife blade 29D (see FIG. 1) is raised up and down within the hopper 23 and a knife blade 123 is raised up and down within the hopper 22 through an air cylinder 124. This insures that there is always a supply of the hooks 12 (see FIG. 3) on the rail 31 within the hopper 23 and of the heads 11 (see FIG. 7) on a bar 125 (see FIG. 1) on the knife blade 123 within the hopper 22.

Figure 9:
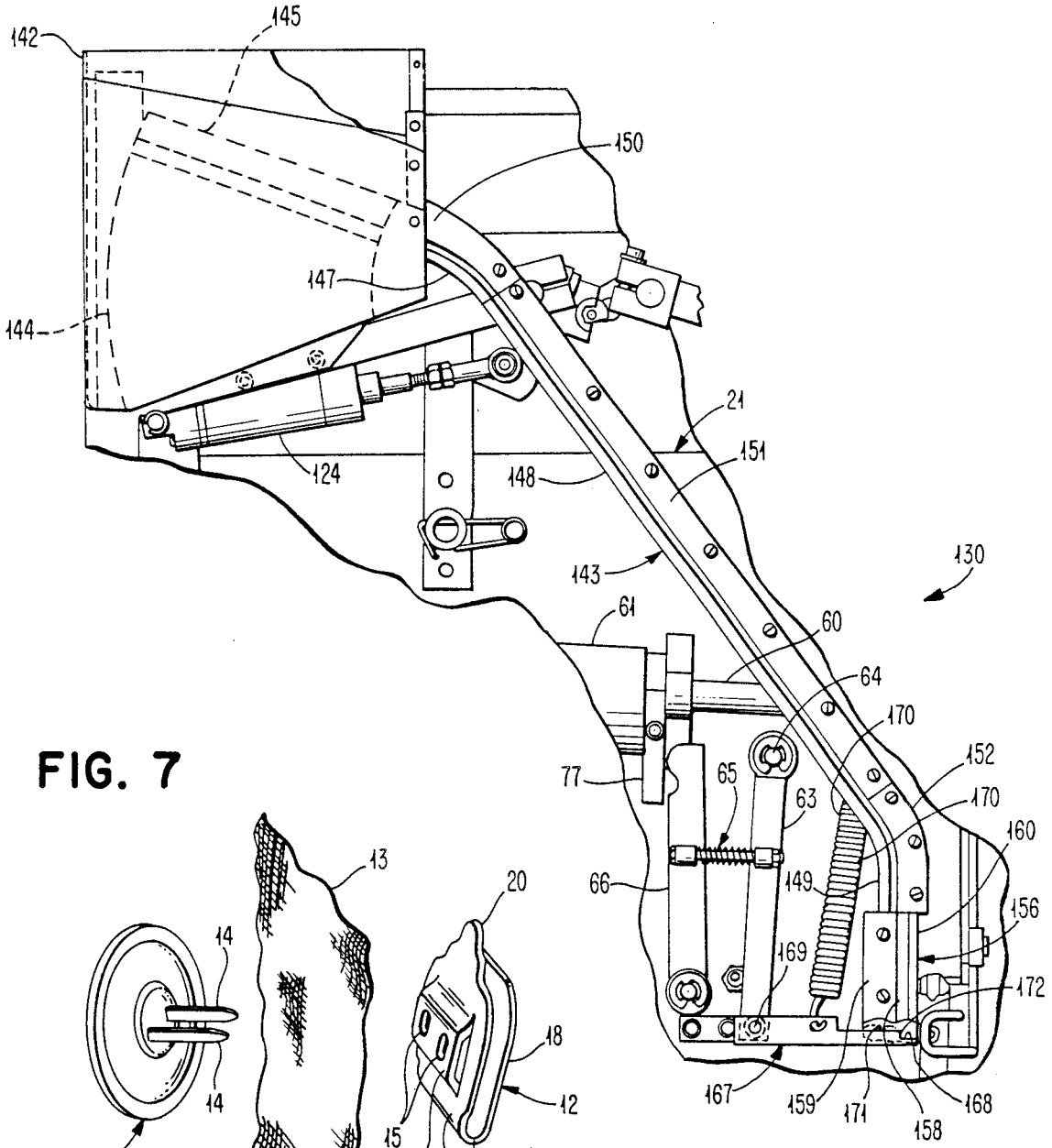
FIG. 9 is a fragmentary side elevational view of a portion of an attaching apparatus for attaching a non-symmetrical eye to a symmetrical element and having a unique feeding arrangement for the eye.

Referring to FIG. 9, there is shown an attaching apparatus 130 for attaching a non-symmetrical shaped eye 131 (see FIG. 14) to a two prong element 132. The attaching apparatus 130 (see FIG. 9) is substantially the same as the attaching apparatus 10 (see FIG. 1) and only those portions of the attaching apparatus 130 (see FIG. 9) that are different from the attaching apparatus 10 (see FIG. 1) will be shown and described.

The two prong element 132 (see FIG. 14), which is symmetrical but could have other shapes, if desired, has two prongs 133 extending therefrom for disposition in two holes 134 in the eye 131 after the two prongs 133 pass through the material 13. The holes 134 are disposed in a depressed part 134' of a portion 135 of the eye 131. The portion 135 is in a plane slightly above a flat portion 136 of the eye 131.

The eye 131 has bent portions 137 (see FIG. 15) and 138 extending from opposite ends of the flat portion 136 substantially perpendicular thereto. The portion 137 has a flat portion 139 extending therefrom substantially perpendicular thereto and substantially parallel to the flat portion 136. The portion 138 has a flat portion 140 extending therefrom substantially perpendicular thereto and substantially parallel to the flat portion 136. The flat portions 139 and 140 are in the same plane and terminate slightly prior to each other. The flat portions 136, 139, and 140 cooperate with the bent portions 137 and 138 to form an opening 141 within which the second portion 18 (see FIG. 7) of the hook 12 is received when the hook 12 and the eye 131 (see FIG. 14) are attached to the material 13, which can be two opposite portions of a pair of jeans, for example.

When the hook 12 (see FIG. 7) and the eye 131 (see FIG. 14) are attached to two opposite portions of a pair of jeans, for example, the opposite portions of the jeans can be fastened by the second portion 18 (see FIG. 7) of the hook 12 entering the opening 141 (see FIG. 15) in the eye 131 as shown in FIG. 15 where the hook 12 is shown in phantom in its fully inserted position. The depressed part 134' of the portion 135 of the eye 131 has the bent ends of the prongs 133 (see FIG. 14) therein so that there is no interference with movement of the second portion 18 (see FIG. 7) of the hook 12 into the opening 141 (see FIG. 15) in the eye 131. The bent ends of the prongs 14 (see FIG. 7) of the hook 12 are disposed within the raised area 16 of the first portion 17 so as not to extend beyond the plane of the first portion 17. This prevents any engagement of the prongs 14 with the flat portions 139 (see FIG. 15) and 140 during insertion of the second portion 18 (see FIG. 7) of the hook 12 into the opening 141 (see FIG. 15) in the eye 131.

The attaching apparatus 130 (see FIG. 9) includes a hopper 142 having the eyes 131 (see FIG. 14) therein. An upper feed chute 143 (see FIG. 9) has its upper end supported by the hopper 142. The upper feed chute 143 has its upper end receive each of the non-symmetrical shaped eyes 131 (see FIG. 14) from an outlet of the hopper 142 (see FIG. 9).

Figure 11:
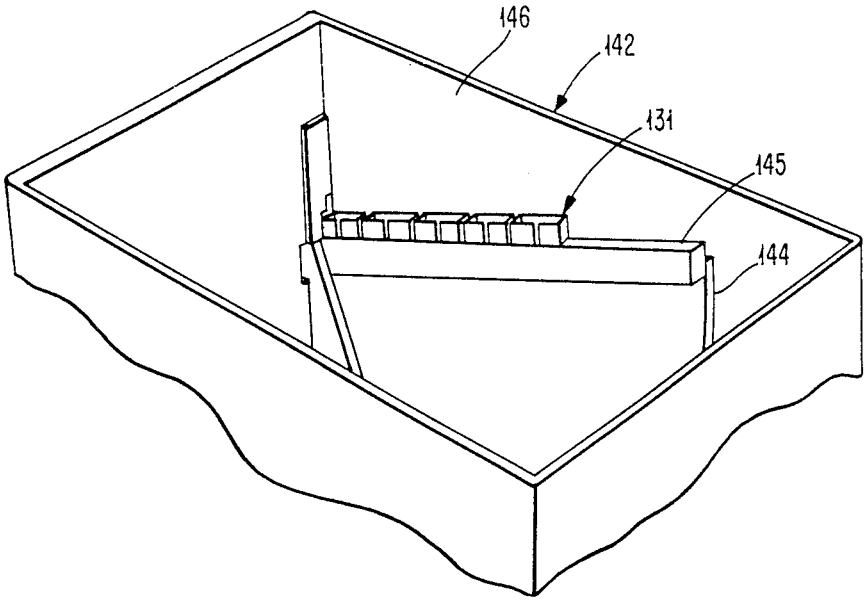
FIG. 11 is a fragmentary perspective view of a hopper of the attaching apparatus of FIG. 9 with the hopper having an arrangement for supplying eyes to the feed chutes.

As shown in FIG. 11, a pivotally mounted knife blade 144 has a bar 145 at its upper end disposed adjacent a front wall 146 of the hopper 142. The bar 145 is slightly spaced from the front wall 146 of the hopper 142 so that only the portion 135 (see FIG. 15) of each of the eyes 131 can enter between the bar 145 (see FIG. 11) and the front wall 146 of the hopper 142. This provides the correct orientation of the eye 131 prior to the eye 131 exiting from the hopper 142 through its outlet.

During each activation, the knife blade 144 picks up more of the eyes 131 than are needed to supply the upper feed chute 143 (see FIG. 9). The knife blade 144 is activated during each cycle of operation by the air cylinder 124.

The hopper 142 (see FIG. 11) has its outlet shaped so that each of the eyes 131 can pass therethrough only when the eye 131 has the desired orientation with the portion 135 (see FIG. 15) of the eye 131 disposed between the front wall 146 (see FIG. 11) of the hopper 142 and the bar 145 on the knife blade 144. Therefore, only each of the eyes 131 having the proper orientation will enter the upper feed chute 143 (see FIG. 9).

The upper feed chute 143 includes a curved upper rail 147, a straight middle rail 148, and a curved lower rail 149. The middle rail 148 is attached to each of the rails 147 and 149.

Figure 10:
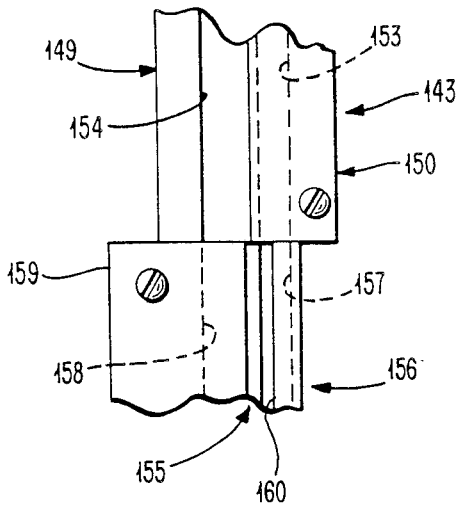
FIG. 10 is a schematic plan view of portions of feed chutes of the attaching apparatus of FIG. 9.

A curved upper cover 150 is attached to the curved upper rail 147, a straight middle cover 151 is attached to the straight middle rail 148, and a curved lower cover 152 is attached to the curved lower rail 149. Each of the rails 147–149 of the upper feed chute 143 has a first channel 153 (see FIG. 10) and a second channel 154 formed therein with the first channel 153 being deeper than the second channel 154, which is wider than the first channel 153. Thus, the portion 135 (see FIG. 15) of each of the eyes 131 rides in the wider second channel 154 (see FIG. 10) and the remainder of the eye 131 (see FIG. 15) rides in the deeper first channel 153 (see FIG. 10).

The lower rail 149 of the upper feed chute 143 is attached to a curved rail 155 of a lower feed chute 156. The rail 155 has a first channel 157 aligned with the first channel 153 in the lower rail 149 of the upper feed chute 143 and a second channel 158 aligned with the second channel 154 in the lower rail 149 of the upper feed chute 143. The first channel 157 is deeper than the second channel 158, which is wider than the first channel 157, in the same manner as the first channel 153 is deeper than the second channel 154 in the curved lower rail 149 of the upper feed chute 143.

The curved rail 155 of the lower feed chute 156 has a first cover 159 attached thereto and overlying most of the second channel 158 in the rail 155 of the lower feed chute 156. A second L-shaped cover 160 is attached to the rail 155 of the lower feed chute 156 and overlies a portion of the first channel 157 in the rail 155 of the lower feed chute 156.

Figure 12:
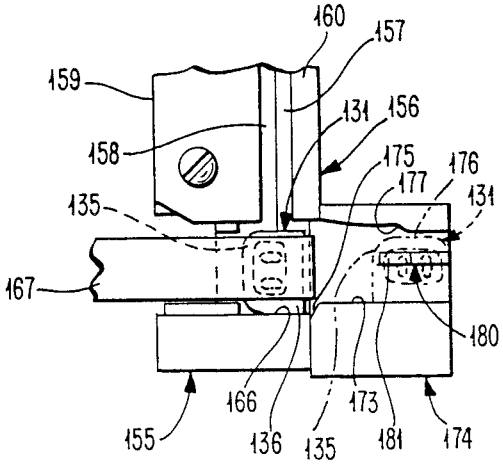
FIG. 12 is a fragmentary bottom plan view of a portion of a guide channel of the attaching apparatus of FIG. 9 in which the eye has its orientation changed with the eye shown in phantom position in its final orientation and showing a feed in finger disposed in the guide channel.

As shown in FIG. 12, each of the covers 159 and 160 terminates prior to a wall of the rail 155 to form a guide channel 166 therebetween into which each of the eyes 131 is disposed. The guide channel 166 has a feed in finger 167 disposed therein for reciprocation.

The feed in finger 167 includes a saddle 168 (see FIG. 9) forming the bottom of the guide channel 166 (see FIG. 12) when the feed in finger 167 is in its retracted position. Thus, the lowermost of the eyes 131 in the lower feed chute 156 will rest on the saddle 168 (see FIG. 9) of the feed in finger 167 when it falls into the guide channel 166 (see FIG. 12).

The feed in finger 167 is pivotally connected to the lever 63 (see FIG. 9) by a pivot pin 169. Therefore, the retraction and extension of the feed in finger 167 is controlled in the same manner as the feed in finger 58 (see FIG. 1) of the attaching apparatus 10. A spring 170 (see FIG. 9) continuously urges the feed in finger 167 counterclockwise about the pivot pin 169 so that the saddle 168 of the feed in finger 167 is always held against the eye 131 (see FIG. 12) in the guide channel 166.

The feed in finger 167 (see FIG. 9) includes a portion 171, which is thicker than the saddle 168. The portion 171 of the feed in finger 167 blocks the bottom of the lower feed chute 156 (see FIG. 12) when the feed in finger 167 is advanced within the guide channel 166 to prevent the lowermost of the eyes 131 in the lower feed chute 156 from falling into the guide channel 166.

As the feed in finger 167 is advanced within the guide channel 166, an end 172 (see FIG. 9) of the portion 171 engages the portion 135 (see FIG. 12) of the eye 131 to begin to advance the eye 131 from the guide channel 166 towards a guide channel 173, which is a continuation of the guide channel 166, in a mounting block 174. The mounting block 174 is secured to the rail 155 of the lower feed chute 156 and to the support 21 (see FIG. 9) to mount the rail 155 (see FIG. 12) on the support 21 (see FIG. 9).

As the eye 131 (see FIG. 12) is advanced by the feed in finger 167 into the guide channel 173, the portions 136 (see FIG. 15), 138, and 140 of the eye 131 engage a cam surface 175 (see FIG. 12) in the mounting block 174 to rotate the eye 131 clockwise 90°. This produces the desired orientation of the eye 131.

As the eye 131 is advanced by the feed in finger 167 through the guide channel 173 in the mounting block 174, a surface 176 of the portion 135 can engage a camming surface 177 in the mounting block 174. This insures that the eye 131 will have the desired orientation when it enters between two side plates 178 (see FIG. 13) and 179, which replace the side plates 68 (see FIG. 2) and 69 on the cylinder 70.

The guide channel 173 (see FIG. 12) in the mounting block 174 has a guide 180 therein to maintain the eye 131 in its desired orientation just prior to the eye 131 entering between the guide plates 178 (see FIG. 13) and 179, which are adjacent the mounting block 174 at the exit of the guide channel 173. The guide 180 (see FIG. 12) has a camming ramp surface 181 to insure that the eye 131 enters the side plates 178 (see FIG. 13) and 179 in the correct orientation.

As shown in FIG. 13, the side plate 178 has a passage 182 in its surface 183 to receive the portion 135 of the eye 131 as the feed in finger 167 (see FIG. 12) advances the eye 131 between the side plates 178 (see FIG. 13) and 179. The passage 182 terminates in an enlarged recess 184 in the surface 183 within which the surface 176 of the portion 135 of the eye 131 rests.

The side plate 179 has a flat surface 186 against which the ends of the portions 136–140 (see FIG. 15) of the eye 131 rest. Thus, the eye 131 is held between the side plates 178 (see FIG. 13) and 179.

The remainder of the operation of the attaching apparatus 130 (see FIG. 9) is the same as that described for the attaching apparatus 10 (see FIG. 1). Therefore, the eye 131 (see FIG. 14) is attached to the material 13 and the two prong element 132.

An advantage of this invention is that an aesthetic element can be attached to a non-symmetrical hook or eye. Another advantage of this invention is that a hook or eye can be attached to material without damaging the material so that replacement of the hook or eye may be made without the material becoming defective.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

We claim:

1. An apparatus for attaching a two prong element and a non-symmetrical shaped element to material at a setting station including:

anvil means and ram means at the setting station;

activating means for activating said anvil means and said ram means to move said anvil means and said ram means toward each other, each of said ram means and said anvil means being movable only axially;

a first hopper having a plurality of two prong elements therein;

a second hopper having a plurality of non-symmetrical shaped elements therein;

each of the non-symmetrical shaped elements having two holes therein to receive the prongs on the two prong element;

first transport means for transporting each of the two prong elements from said first hopper to a position at the setting station in a specific orientation for engagement by said anvil means;

second transport means for transporting each of the non-symmetrical shaped elements from said second hopper to the setting station for engagement by said ram means, said second transport means transporting each of the non-symmetrical shaped elements from said second hopper in a first orientation;

and said second transport means having cooperating means for cooperating with each of the non-symmetrical shaped elements prior to its disposition at the setting station to dispose each of the non-symmetrical shaped elements in a second orientation, different from the first orientation, for engagement by said ram means with the two holes in the non-symmetrical shaped element oriented to receive the two prongs of the two prong element engaged by said anvil means.

2. An apparatus for attaching a two prong element and a non-symmetrical shaped element to material at a setting station including:

anvil means and ram means at the setting station;

activating means for creating relative movement between said anvil means and said ram means;

a first hopper having a plurality of two prong elements therein;

a second hopper having a plurality of non-symmetrical shaped elements therein;

each of the non-symmetrical shaped elements having two holes therein to receive the prongs on the two prong element;

first transport means for transporting each of the two prong elements from said first hopper to a position at the setting station in a specific orientation for engagement by said anvil means;

second transport means for transporting each of the non-symmetrical shaped elements from said second hopper to the setting station for engagement by said ram means, said second transport means transporting each of the non-symmetrical shaped elements from said second hopper in a first orientation;

said second transport means having cooperating means for cooperating with each of the non-symmetrical shaped elements prior to its disposition at the setting station to dispose each of the non-symmetrical shaped elements in a second orientation, different from the first orientation, for engagement by said ram means with the two holes in the non-symmetrical shaped element oriented to receive the two prongs of the two prong element engaged by said anvil means;

and said second transport means including; feed chute means having one end communicating with said second hopper to receive each of the non-symmetrical shaped elements from said second hopper;

a guide channel having one end communicating with the other end of said feed chute means to receive each of the non-symmetrical shaped elements from said feed chute means and its other end communicating with the setting station;

one of said feed chute means and said guide channel having said cooperating means;

and advancing means for advancing each of the non-symmetrical shaped elements through said guide channel to the setting station for engagement by said ram means.

3. The apparatus according to claim 2 including gripping means at the setting station for gripping each of the non-symmetrical shaped elements prior to its movement by said ram means.

4. The apparatus according to claim 3 in which:

said gripping means includes a pair of side plates;

and at least one of said side plates has cooperating means for cooperating with each of the non-symmetrical shaped elements to maintain the gripped non-symmetrical shaped element in its desired orientation within said side plates.

5. The apparatus according to claim 4 in which said cooperating means of said second transport means includes engaging means in said chute means for engaging each of the non-symmetrical shaped elements to change the non-symmetrical shaped elements from its first orientation to its second orientation.

6. The apparatus according to claim 5 in which:

said feed chute means includes: a first portion communicating with said second hopper; and a second channel portion communicating with said guide channel;

and said engaging means includes rotatable means disposed between said first portion of said feed chute means and said second portion of said feed chute means for rotating each of the non-symmetrical shaped elements from its first orientation to its second orientation.

7. The apparatus according to claim 6 in which said rotatable means of said engaging means includes:

receiving means for receiving the lowermost of the non-symmetrical shaped elements in said first portion of said feed chute means, said receiving means retaining the non-symmetrical shaped element thereon during rotation of said rotatable means of said engaging means until the non-symmetrical shaped element can fall from said receiving means by gravity into said second portion of said feed chute means;

and preventing means for preventing the lowermost of the non-symmetrical shaped elements in said first portion of said feed chute means from escaping therefrom until said receiving means is again disposed by rotation of said rotatable means of said engaging means to receive the lowermost of the non-symmetrical shaped elements in said first portion of said feed chute means.

8. The apparatus according to claim 7 including connecting means for connecting said rotatable means of said engaging means to said activating means to cause movement of said rotatable means of said engaging means in response to movement of said activating means.

9. The apparatus according to claim 8 in which said connecting means includes means for enabling manual activation of said rotatable means of said engaging means independent of movement in response to movement of said activating means.

10. The apparatus according to claim 5 in which said advancing means includes blocking means for blocking communication of said feed chute means with said guide channel when said advancing means advances one of the non-symmetrical shaped elements through said guide channel by said advancing means being advanced from an initial position, said blocking means becoming ineffective when said advancing means is withdrawn to its initial position.

11. The apparatus according to claim 4 in which said cooperating means of said second transport means includes engaging means in said guide channel for engaging each of the non-symmetrical shaped elements to change each of the non-symmetrical shaped elements from its first orientation to its second orientation during its advancement through said guide channel by said advancing means.

12. The apparatus according to claim 11 in which said advancing means includes blocking means for blocking communication of said feed chute means with said guide channel when said advancing means advances one of the non-symmetrical shaped elements through said guide channel by said advancing means being advanced from an initial position, said blocking means becoming ineffective when said advancing means is withdrawn to its initial position.

13. The apparatus according to claim 2 in which said cooperating means includes engaging means in said feed chute means for engaging each of the non-symmetrical shaped elements to change the non-symmetrical shaped element from its first orientation to its second orientation.

14. The apparatus according to claim 13 in which:

said feed chute means includes: a first portion communicating with said second hopper; and a second portion communicating with said guide channel;

and said engaging means includes rotatable means disposed between said first portion of said feed chute means and said second portion of said feed chute means for rotating each of the non-symmetrical shaped elements from its first orientation to its second orientation.

15. The apparatus according to claim 14 in which said rotatable means of said engaging means includes:

receiving means for receiving the lowermost of the non-symmetrical shaped elements in said first portion of said feed chute means, said receiving means retaining the non-symmetrical shaped element thereon during rotation of said rotatable means of said engaging means until the non-symmetrical shaped element can fall from said receiving means by gravity into said second portion of said feed chute means;

and preventing means for preventing the lowermost of the non-symmetrical shaped elements in said first portion of said feed chute means from escaping therefrom until said receiving means is again disposed by rotation of said rotatable means of said engaging means to receive the lowermost of the non-symmetrical shaped elements in said first portion of said feed chute means.

16. The apparatus according to claim 15 including connecting means for connecting said rotatable means of said engaging means to said activating means to cause movement of said rotatable means of said engaging means in response to movement of said activating means.

17. The apparatus according to claim 16 in which said connecting means includes means for enabling manual activation of said rotatable means of said engaging means independent of movement in response to movement of said activating means.

18. The apparatus according to claim 17 in which said advancing means includes blocking means for blocking communication of said feed chute means with said guide channel when said advancing means advances one of the non-symmetrical shaped elements through said guide channel by said advancing means being advanced from an initial position, said blocking means becoming ineffective when said advancing means is withdrawn to its initial position.

19. The apparatus according to claim 2 in which said cooperating means includes engaging means in said guide channel for engaging each of the non-symmetrical shaped elements to change each of the non-symmetrical shaped elements from its first orientation to its second orientation during its advancement through said guide channel by said advancing means.

20. The apparatus according to claim 19 in which said advancing means includes blocking means for blocking communication of said feed chute means with said guide channel when said advancing means advances one of the non-symmetrical shaped elements through said guide channel by said advancing means being advanced from an initial position, said blocking means becoming ineffective when said advancing means is withdrawn to its initial position.

* * * * *

UNITED STATES PATENT AND TRADEMARK OFFICE

CERTIFICATE OF CORRECTION

PATENT NO. : 4,985,987

DATED : January 22, 1991

INVENTOR(S) : Volker Schmidt et al

It is certified that error appears in the above-identified patent and that said Letters Patent is hereby corrected as shown below:

In the Abstract, line 11, "betwen" should read --- between --- .

Column 7, line 52, after "al" and before the comma (,) (first occurrence) insert --- patent --- .

UNITED STATES PATENT AND TRADEMARK OFFICE

CERTIFICATE OF CORRECTION

PATENT NO. : 4,985,987

DATED : January 22, 1991

INVENTOR(S) : Volker Schmidt et al

It is certified that error appears in the above-identified patent and that said Letters Patent is hereby corrected as shown below:

Column 13, lines 48 to 62 should read:

and said second transport means including:

feed chute means having one end communicating with said second hopper to receive each of the non-symmetrical shaped elements from said second hopper;

a guide channel having one end communicating with the other end of said feed chute means to receive each of the non-symmetrical shaped elements from said feed chute means and its other end communicating with the setting station;

one of said feed chute means and said guide channel having said cooperating means;

and advancing means for advancing each of the non-symmetrical shaped elements through said guide channel to the setting station for engagement by said ram means.

Column 14, line 8, after "said" insert --- feed ---.

UNITED STATES PATENT AND TRADEMARK OFFICE

CERTIFICATE OF CORRECTION

PATENT NO. : 4,985,987

DATED : January 22, 1991

INVENTOR(S) : Volker Schmidt et al

It is certified that error appears in the above-identified patent and that said Letters Patent is hereby corrected as shown below:

Column 14, lines 12 to 23 should read:

6. The apparatus according to claim 5 in which:

said feed chute means includes:

a first portion communicating with said second hopper;

and a second portion communicating with said guide channel;

and said engaging means includes rotatable means disposed between said first portion of said feed chute means and said second portion of said feed chute means for rotating each of the non-symmetrical shaped elements from its first orientation to its second orientation.

UNITED STATES PATENT AND TRADEMARK OFFICE

CERTIFICATE OF CORRECTION

PATENT NO. : 4,985,987

DATED : January 22, 1991

INVENTOR(S) : Volker Schmidt et al

It is certified that error appears in the above-identified patent and that said Letters Patent is hereby corrected as shown below:

Column 15, lines 18 to 27 should read:

14. The apparatus according to claim 13 in which:

said feed chute means includes:

a first portion communicating with said second hopper;

and a second portion communicating with said guide channel;

and said engaging means includes rotatable means disposed between said first portion of said feed chute means and said second portion of said feed chute means for rotating each of the non-symmetrical shaped elements from its first orientation to its second orientation.

Signed and Sealed this

First Day of December, 1992

*Attest:*

DOUGLAS B. COMER

*Attesting Officer*

*Acting Commissioner of Patents and Trademarks*